US005202701A

United States Patent [19]

Casey

[11] Patent Number: 5,202,701

[45] Date of Patent: Apr. 13, 1993

[54] LOW RADAR CROSS SECTION REFLECTOR ANTENNA

[75] Inventor: James A. Casey, Smithtown, N.Y.

[73] Assignee: Grumman Aerospace Corporation, Bethpage, N.Y.

[21] Appl. No.: 734,542

[22] Filed: Jul. 23, 1991

[51] Int. Cl.[5] ..... H01Q 17/00

[52] U.S. Cl. ..... 343/909; 343/837; 343/912

[58] Field of Search ..... 343/909, 912, 815, 819, 343/756, 837, 838

[56] References Cited

U.S. PATENT DOCUMENTS 3,771,160 11/1973 Laverick ..... 343/909
4,284,992 8/1981 Gans ..... 343/909
4,381,510 4/1983 Wren ..... 343/909
4,599,623 7/1986 Havkin et al. ..... 343/909
4,743,919 5/1988 Chang et al. ..... 343/914
4,786,915 11/1988 Cartwright et al. ..... 343/909

*Primary Examiner*—Michael C. Wimer
*Assistant Examiner*—Tan Ho
*Attorney, Agent, or Firm*—William B. Ritchie

[57] ABSTRACT

An antenna system includes a reflector grid which reflects signals which are within the operative frequency range of the antenna and passes received signals of higher frequency. An absorber is placed proximate to the reflector grid to absorb signals which are passed by the grid. A second reflector located proximate to the absorber reflects signals back through the absorber such that signals reflected by the antenna system are twice attenuated by the absorber.

6 Claims, 1 Drawing Sheet

LOW RADAR CROSS SECTION REFLECTOR ANTENNA

FIELD OF THE INVENTION

The invention relates generally to antennas, and more particularly to antennas which require reflectors to shape their antenna radiation patterns and also require small radar cross sections.

BACKGROUND OF THE INVENTION

It is well known to include reflectors in directional antennas in order to shape the antenna radiation pattern. The reflectors also eliminate signal transmissions in directions other than the selected, or principal, direction which may interfere with the signal transmissions of nearby antennas.

Various parts of an antenna structure, for example, an antenna support, may act as unintended and unwanted reflectors, reflecting signals away from the principal direction. These reflected signals may adversely affect the transmission in the principal direction and/or interfere with nearby transmissions. In order to minimize such reflections, many antenna systems include absorbers. The absorbers, or signal attenuators, are placed over or around the unwanted reflectors. When the antenna transmits a signal, the portion of the signal which would otherwise be reflected by the unwanted reflector is instead "absorbed" or largely attenuated by the absorber. The unwanted reflection is thus relatively weak and less likely to interfere with the transmissions of that or any nearby antenna.

Antenna reflectors reflect any signal they receive, not just the signals transmitted by the associated antenna. Typically, such reflections are ignored because they do not interfere with the signals transmitted by the antenna. For example, reflectors included in antennas designed for low frequency signal transmission also reflect higher frequency radar signals. If the antennas are used on vehicles for which a low radar profile is desired such reflections cannot be ignored, because they increase the radar cross section of the vehicle.

Absorbers can be used to attenuate the signals reflected by the portions of the vehicle which are not intentionally used as antenna reflectors. However, absorbers can not be used to attenuate the signals reflected by the antenna reflectors without rendering the antenna virtually useless. What is needed is a mechanism which enables an antenna reflector to reflect signals within the operative frequency range of the antenna and attenuate signals outside that range.

SUMMARY

The present invention is directed to an antenna for use on vehicles, aircraft or installations requiring small radar cross sections. The antenna includes a reflector grid which reflects signals which are within the operative frequency range of the antenna and passes received signals of higher frequencies. The antenna also includes an absorber which is positioned between the reflector grid and the vehicle to attenuate the signals which pass through the reflector grid. The absorber has as its opposite end a metal, or reflective, plate which reflects the attenuated signals back to the absorber. The absorber then further attenuates the reflected signals as they pass through the absorber a second time. The resulting attenuated reflected signals, which are relatively weak, then pass back through the reflector grid as the reflection of the received signals.

The reflector grid consists of "n" parallel wires which are separated by a distance of "A", where A is a relatively small percentage of a wavelength, $\lambda_1$, which is associated with the cut-off frequency at the high end of the operative frequency range of the antenna. Due to the spacing of the wires, the reflector grid is effectively a reflective surface for signals which have wavelengths of approximately $\lambda_1$ or larger. For signals having smaller wavelengths, however, the grid is to varying degrees transparent.

BRIEF DESCRIPTION OF THE DRAWINGS

For a more complete understanding of the features, advantages, and objects of the invention, reference should be made to the following detailed description and the accompanying drawings, in which.

DETAILED DESCRIPTION

Figure 1:
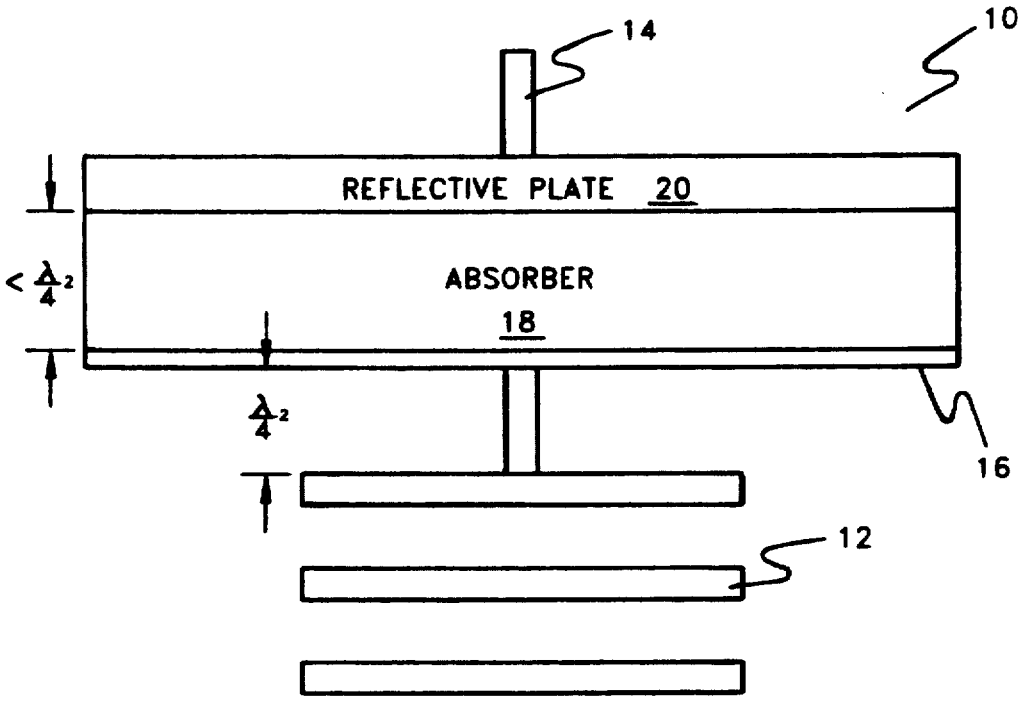
FIG. 1 is an illustration of an antenna system constructed in accordance with the invention.

FIG. 1 depicts a top view of an antenna system 10 constructed in accordance with the invention. The antenna system consists of a conventional antenna 12 and connector 14, shown as a Yagi-style antenna in the drawing, a reflector grid 16 and an absorber 18. The absorber 18 may, for example, be a polyimide foam with lossy carbon film, such as is commercially available from Cuming Corporation of South Easton, Mass. The antenna 12 and the reflector grid 16 are spaced apart a distance of approximately $\frac{1}{4}\lambda_2$, where $\lambda_2$ is a wavelength associated with the center frequency of the operative frequency range of the antenna. Such spacing is conventional for Yagi antennas.

As explained in more detail below with reference to FIG. 2, the reflector grid 16 reflects signals within the operative frequency range of the antenna and does not as readily reflect signals of higher frequencies. When the antenna system receives a high-frequency signal, the signal passes first through the reflector grid 16 and then through the absorber 18. As the signal passes through the absorber 18, the absorber attenuates it, by absorbing some of its energy.

After passing through the absorber 18, the now attenuated signal hits a metal plate 20. The metal plate 20, due to its proximity to the absorber 18, completely reflects the attenuated signal back through the absorber 18. The reflected signal is then further attenuated by absorber 18.

Figure 2:
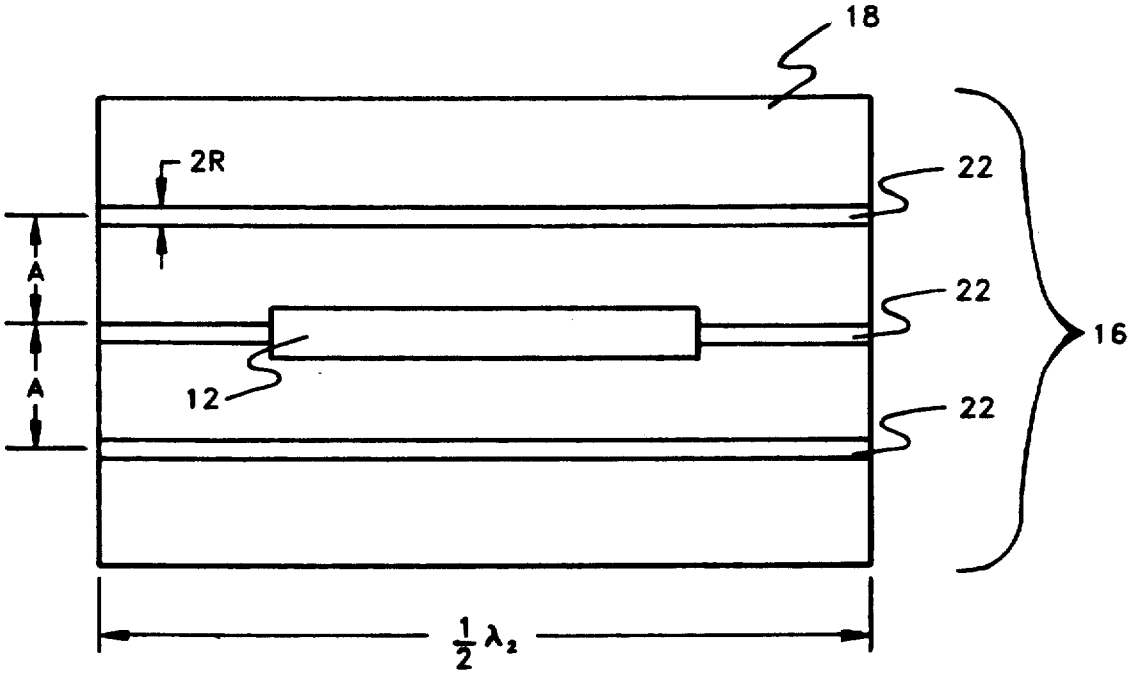
FIG. 2 is an illustration of a front view of the antenna system depicted in FIG. 1.

FIG. 2 depicts a front view of the antenna system 10, which shows the reflector grid 16 in more detail. The reflector grid 16 consists of "n" wires 22 spaced a distance of "A" apart, where A is a small percentage of $\lambda_1$, which corresponds to a cut-off frequency at the high end of the operative frequency range of the antenna. Each wire 22 is approximately $\frac{1}{2}\lambda_2$ long and 2R thick, where R is a fraction of A. In the preferred embodiment A is $0.2\lambda_1$, n is three and A/R is 10. The values of A, A/R and n are chosen to maximize the slope of a line representing the graph of frequency versus percentage of signal energy passing through the grid.

Signals within the operative frequency range hit the grid wires and are reflected, as if the grid were a solid reflective surface. Thus the reflected signals contain virtually the same energy as the transmitted signals.

Signals which are at a higher frequency than the operative range, that is, signals which have shorter wavelenths, sometimes hit the grid wires 22 and are reflected and sometimes pass through the grid wires. The signals which pass through the grid wires are twice attenuated by the absorber before they emerge as reflected signals. The reflected higher frequency signals, which are a combination of the higher frequency signals reflected by the grid wires and the attenuated higher frequency reflected signals emerging from the absorber, contain less energy than the reflected signals associated with the lower frequency signals. Accordingly, the reflected higher frequency signals are harder to detect than the reflected lower frequency signals.

Beyond a certain frequency, most if not all of the received signals pass through the grid to the absorber 18. The absorber then twice attenuates the signals before they emerge as reflected signals. The emerging signals are so weak that they may not be readily recognized as a reflection of the received signals.

If the received signal is a relatively high frequency radar signal, for example, much of the signal energy is attenuated by the absorber rather than reflected. Accordingly, the resulting reflected signal is not what is typically associated with the antenna supporting vehicle. The vehicle thus has a smaller radar cross section than is otherwise expected, and it may avoid detection.

The reflector grid 16 is sized to provide the antenna 12 with a desired radiation pattern when the antenna is transmitting at the center frequency. The grid may include any number of wires 22, however, each wire 22 must be a distance of A from any adjacent wires. The antenna 12 may be any conventional reflector-antenna or array of the same antenna system. The dimensions of the absorber and the spacing of the antenna from the reflector grid are then optimized for the particular antenna.

The antenna system is designed to replace conventional antennas on vehicles, aircraft or installations which require small radar cross section. The antenna system severely attenuates the reflections of received signals which are transmitted at frequencies which are higher than the operative frequency of the antenna. The system also transmits, without such attenuation, signals within the antenna operating frequency range.

The foregoing description has been limited to a preferred embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. An antenna system comprising:

A. an antenna for transmitting signals at frequencies within a predetermined frequency range;

B. a first reflector proximate to the antenna, which further comprises a reflector grid, wherein signals within the predetermined frequency range hit said reflector grid and are reflected, while a portion of the signals which are at a higher frequency pass through said reflector grid and another portion of signals of said higher frequency hit said reflector grid and are reflected;

C. an absorber proximate to the reflector for attenuating signals which are passed by the reflector grid; and D. a second reflector proximate to the absorber for reflecting signals passing through the absorber back to the absorber, such that the reflected signals are twice attenuated.

2. The antenna system of claim 1, wherein the first reflector consists of a plurality of substantially parallel wires.

3. The antenna system of claim 1, wherein the second reflector consists of a reflective plate.

4. The antenna system of claim 2, wherein the wires of the first reflector are spaced apart by a distance A, where A is a small percentage of a wavelength associated with the predetermined frequency range.

5. The antenna system of claim 4, wherein the wires of the first reflector are spaced apart by a distance which is about 0.2 times the associated wavelength.

6. The antenna system of claim 1, wherein the absorber has a thickness of less than ¼ of a wavelength associated with the center of the predetermined frequency range.

* * * * *